US006336315B2

(12) United States Patent
Stahlecker

(10) Patent No.: US 6,336,315 B2
(45) Date of Patent: Jan. 8, 2002

(54) SPINNING MACHINE HAVING A PLURALITY OF SPINNING STATIONS AND METHOD OF MAKING SAME

(75) Inventor: Gerd Stahlecker, Eislingen/Fils (DE)

(73) Assignee: Wilhelm Stahlecker GmbH, Deggingen-Reichenbach i.T. (DE)

( * ) Notice: Subject to any disclaimer, the term of this patent is extended or adjusted under 35 U.S.C. 154(b) by 0 days.

(21) Appl. No.: 09/842,983

(22) Filed: Apr. 27, 2001

(30) Foreign Application Priority Data

Apr. 27, 2000 (DE) ..... 100 20 694

(51) Int. Cl.[7] ..... O01H 7/46
(52) U.S. Cl. ..... 57/264; 57/75; 57/81
(58) Field of Search ..... 57/22, 261, 262, 57/264, 81, 78, 75, 80, 265

(56) References Cited

U.S. PATENT DOCUMENTS

| | | | | | |
|---|---|---|---|---|---|
| 3,498,039 A | * | 3/1970 | Kent et al. | ..... | 57/81 |
| 3,789,595 A | * | 2/1974 | Bernstein et al. | ..... | 57/265 |
| 3,902,308 A | * | 9/1975 | Bernstein et al. | ..... | 57/265 |
| 4,122,657 A | | 10/1978 | Felix | ..... | 57/81 |
| 4,404,791 A | * | 9/1983 | Wolf et al. | ..... | 57/81 |
| 6,112,508 A | * | 9/2000 | Felix | ..... | 57/265 |

FOREIGN PATENT DOCUMENTS

| | | | | |
|---|---|---|---|---|
| DE | 27 31 019 | | 5/1978 | |
| DE | 3237371 | * | 9/1983 | ..... 57/265 |
| DE | 44 12 670 | | 10/1995 | |
| EP | 286046 | * | 4/1988 | ..... 57/265 |

* cited by examiner

*Primary Examiner*—Danny Worrell
(74) *Attorney, Agent, or Firm*—Crowell & Moring LLP

(57) ABSTRACT

The spinning stations of a spinning machine each have a drafting unit and a stopping device for fiber material fed to the drafting unit. A first carriage is movable along the length of the spinning machine, which carriage comprises a sensor for detecting a broken thread at a spinning station. Spatially separated from this first carriage is a second carriage, which is moveable along the length of the spinning machine, which second carriage is provided with an actuator for activating the stopping device of a spinning station in need of maintenance.

33 Claims, 5 Drawing Sheets

SPINNING MACHINE HAVING A PLURALITY OF SPINNING STATIONS AND METHOD OF MAKING SAME

BACKGROUND AND SUMMARY OF THE INVENTION

This application claims the priority of German Patent Document 100 20 694.8, filed in Germany, Apr. 27, 2001, the disclosure of which is expressly incorporated by reference herein.

The present invention relates to a spinning machine having a plurality of spinning stations, each of which comprise a drafting unit and a stopping device for fiber material fed to the drafting unit, as well as devices movable along the spinning stations for monitoring end breaks and for activating the stopping device of a spinning station needing maintenance.

The spinning stations of a spinning machine have to be monitored for end breaks so that in the case of a spinning station needing maintenance, normal spinning operation can be resumed. Practical experience has shown that in the case of a plurality of spinning stations, it is not always necessary to monitor all spinning stations continuously. Rather more, intermittent scanning at set intervals is frequently permissible, whereby only a fraction of the cost is required for practically the same level of effectiveness.

A spinning machine of the above mentioned type having intermittent end break monitoring is prior art in German published patent application 44 12 670. The means for establishing an end break and for activating a stop device at a spinning station needing maintenance are arranged on one carriage, so that after an end break has been established, the fiber material being fed can be quickly stopped. Because the stop device is located on the one hand in the area of entry of the fiber material in the drafting unit, the thread monitored by the sensor however is located downstream of the drafting unit, the carriage is of relatively large dimensions, for which there is not always the necessary room available on the spinning machine.

It is known from the non-generic German published patent application 27 31 019 (corresponding U.S. Pat. No. 4,122,657) that a sensor for establishing an end break is arranged on a carriage, which is pulled along by a metal, electroconductive traction belt. The electric signals generated by the sensor are transmitted via the traction belt to a stationary plotting station.

It is an object of the present invention, to significantly simplify the spinning machine of the above mentioned type with regard to the above mentioned apparatus.

This object has been achieved in accordance with the present invention in that a first carriage with at least one sensor for monitoring an end break and a second carriage having an actuator for activating the stopping device of a spinning station needing maintenance are provided.

Because the above mentioned apparatus are divided over two carriages, each carriage can be traversely moved to that point where it can carry out its function best. The spatial distance between the stopping device at the drafting unit of a spinning station and the spun thread is no longer of importance. As each carriage only comprises those elements necessary for a particular function, they can be designed to be sufficiently small. Hereby, with regard to the latter mentioned prior art, an electric coupling of the two carriages presents no problems. A purely mechanical coupling in the headstock of the spinning machine is, however, a possible alternative.

Both carriages can, in an embodiment of the present invention, each be pulled backwards and forwards by means of suitable traction means along a running rail. It can be provided that each carriage is arranged at at least one drive motor of its own, located for example in the headstock of the spinning machine, which drive motor activates the traction means. In the case of a flexible traction means, a belt or a wire can be involved.

When, as is generally known, the traction means is electrocondutive, the end break signals can be transmitted via the traction means from the sensor of the first carriage to the actuator of the second carriage. In the case of such electric couplings, the spinning stations in need of maintenance are identified at first by electronic means and this information is subsequently transmitted further.

In the case of such an electric coupling it is purposeful to pull both carriages in the same direction through the machine, whereby the second carriage follows the first carriage at a short distance behind. Thus short time intervals can be observed between the establishing of an end break and the stopping of the fiber material feed at the relevant spinning station.

In the case of certain preferred embodiments of the present invention, a joint drive motor comprising an intermediate gear can be arranged at the traction means of both carriages. The drive motor and the intermediate gear can be located in the headstock of the spinning machine. What is involved here is a purely mechanical coupling without electronic means or electronic spinning station counters.

Also in the latter case, the second carriage can follow the first carriage at a constant distance, in that it, for example, travels behind at a distance of three quarters the distance between two spinning stations. In the latter case it is of course necessary that both carriages can travel beyond all the spinning stations at each machine end.

It is generally known from the latter mentioned prior art that, in the case of a ring spinning machine, the movements of the ring travellers are scanned. The individual ring travellers are moved namely by the thread to be wound up, so that always then, when such a movement of a ring traveller does not occur, it is assumed that an end break is the reason. By taking advantage of this fact, it can further be provided that the first carriage can be guided on a ring rail arranged at the spinning machine. Additionally a sensor for identifying a spinning station can be arranged to the sensor for detecting a broken thread, so that between two spinning stations, where there is no thread present, an end break is not indicated. The identification of a spinning station can, for example, take place via respective bore holes in the ring rail. Over each bore hole, a measuring window could then be opened by a sensor for identifying the ring traveller movements.

These and further objects, features and advantages of the present invention will become more readily apparent from the following detailed description thereof when taken in conjunction with the accompanying drawings wherein:

DETAILED DESCRIPTION OF THE DRAWINGS

Figure 1:
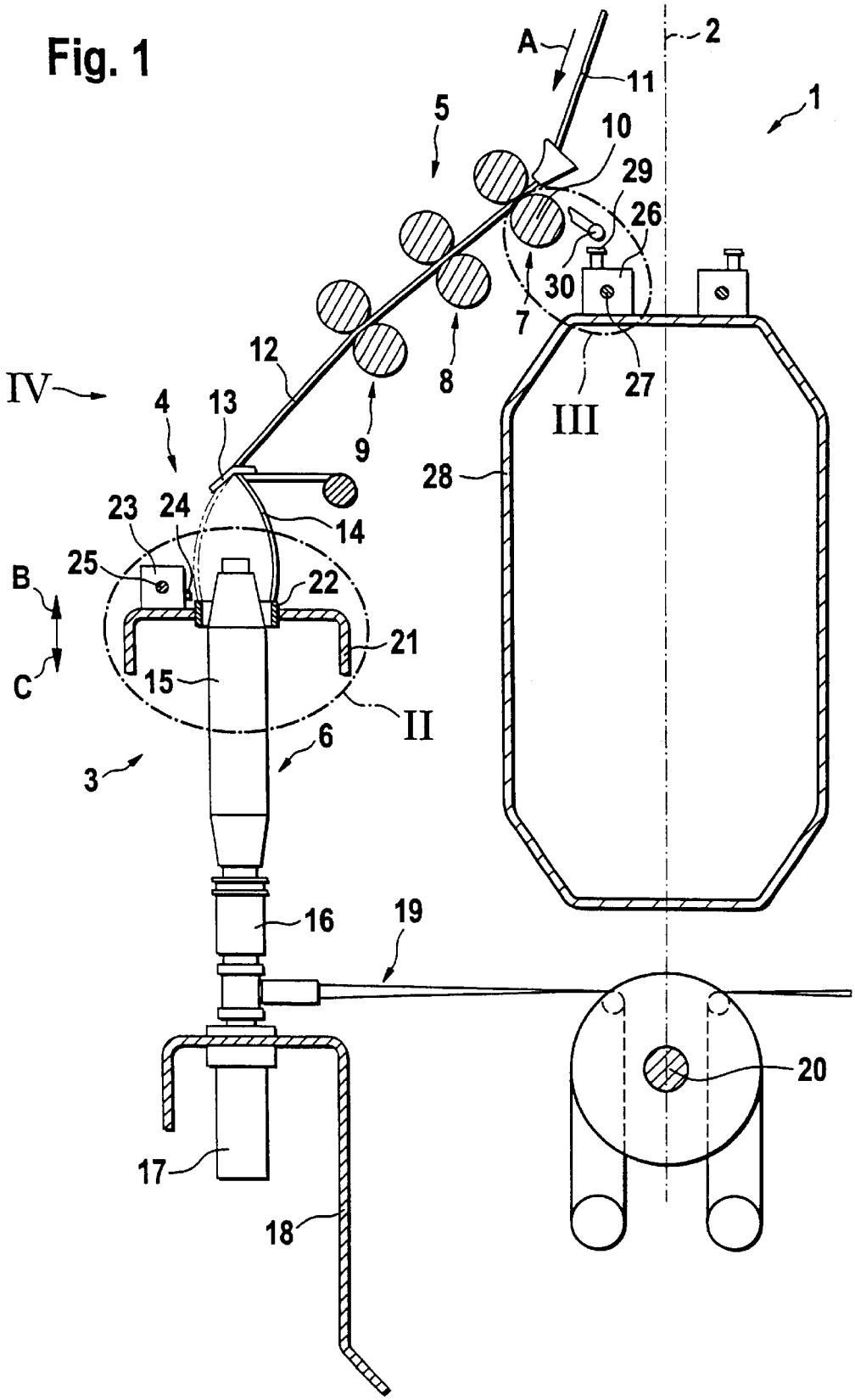
FIG. 1 is a cross section of a very simplified ring spinning machine constructed according to preferred embodiments of the invention.

The cross section of FIG. 1 shows a very simplified spinning machine 1, namely a ring spinning machine, which is symmetrically formed with respect to a dot-dash shown middle longitudinal plane 2, whereby only the machine side 3 located left of the central longitudinal plane 2 can be seen. On each machine side 3, a plurality of identical spinning stations 4 are arranged adjacently to one another.

Important components of each spinning station 4 are a drafting unit 5 as well as a ring spindle 6.

The drafting unit 5 comprises in the known way a plurality of roller pairs 7, 8 and 9 arranged one behind the other in transport direction A, of which the so-called front bottom roller 10 plays an important role in the present invention, and which is described below in more detail. Fiber material 11 to be drafted, for example a sliver or roving, is fed to the drafting unit 5 in a known way, and drafted there to the desired degree of fineness. Directly downstream of the drafting unit 5, the forming thread 12 receives its spinning twist.

The thread 12 travels via a balloon thread guide 13, also known as a "pig's tail", while forming a thread balloon 14 to a bobbin 14, in the present case a rotating spinning cop, onto which the thread is wound. The bobbin 15 is placed on top of a rotating spindle upper part 16 of the ring spindle 6. The bearing housing 17 comprising the rotating parts of the ring spindle 6 is attached to a spindle rail 18 which extends in machine longitudinal direction.

Each ring spindle 6 is driven by a belt drive 19, which receives its drive via a drive shaft 20 which extends in machine longitudinal direction.

A ring rail 21 serves to wind the thread 12 onto the bobbin 15, which ring rail 21 also extends in machine longitudinal direction and is movable up and down according to the traverse motion directions B and C. The ring rail 21 comprises at each spinning station 4 a spinning ring 22, on which a ring traveller (not shown in FIG. 1) rotates in a known way during operation.

When a thread 12 breaks at a spinning station 4, the feed of fiber material 11 to the drafting unit 5 must be stopped after a relatively short time, so that no blockage occurs at the spinning station 4 in need of maintenance. The monitoring of threads 12 with regard to end breaks need not, however, be continuous, but rather can be carried out intermittently, as described above.

As can be seen in FIG. 1, one first carriage 23 per machine side travels on the ring rail 21, which carriage 23 can be on wheels or guided in sliding motion and which comprises a sensor 24 for detecting a broken thread 12. This is described in more detail below with the aid of FIG. 2. The first carriage 23 is pulled along by means of a flexible traction means 25, for example an electroconductive wire.

In the area of the entry bottom rollers 10 of the drafting units 5, a second carriage 26 is movable on each machine side in machine longitudinal direction, also here by means of a flexible traction means 27. The second carriage 26 is movable on the upper side of a suction channel 28 extending in machine longitudinal direction. The second carriage 26 comprises an actuator 29 for activating an activating lever 30 of a stopping device arranged to the drafting unit 5 (stopping device not shown in FIG. 1) for fed fiber material 11. This is described below in more detail with the aid of FIG. 3.

The carriages 23 and 26 can be electrically coupled via their electrocondutive flexible traction means 25 and 27, as described below with the aid of FIG. 4. A mechanical coupling in the headstock of the spinning machine 1 can also be provided, as described below.

Figure 2:
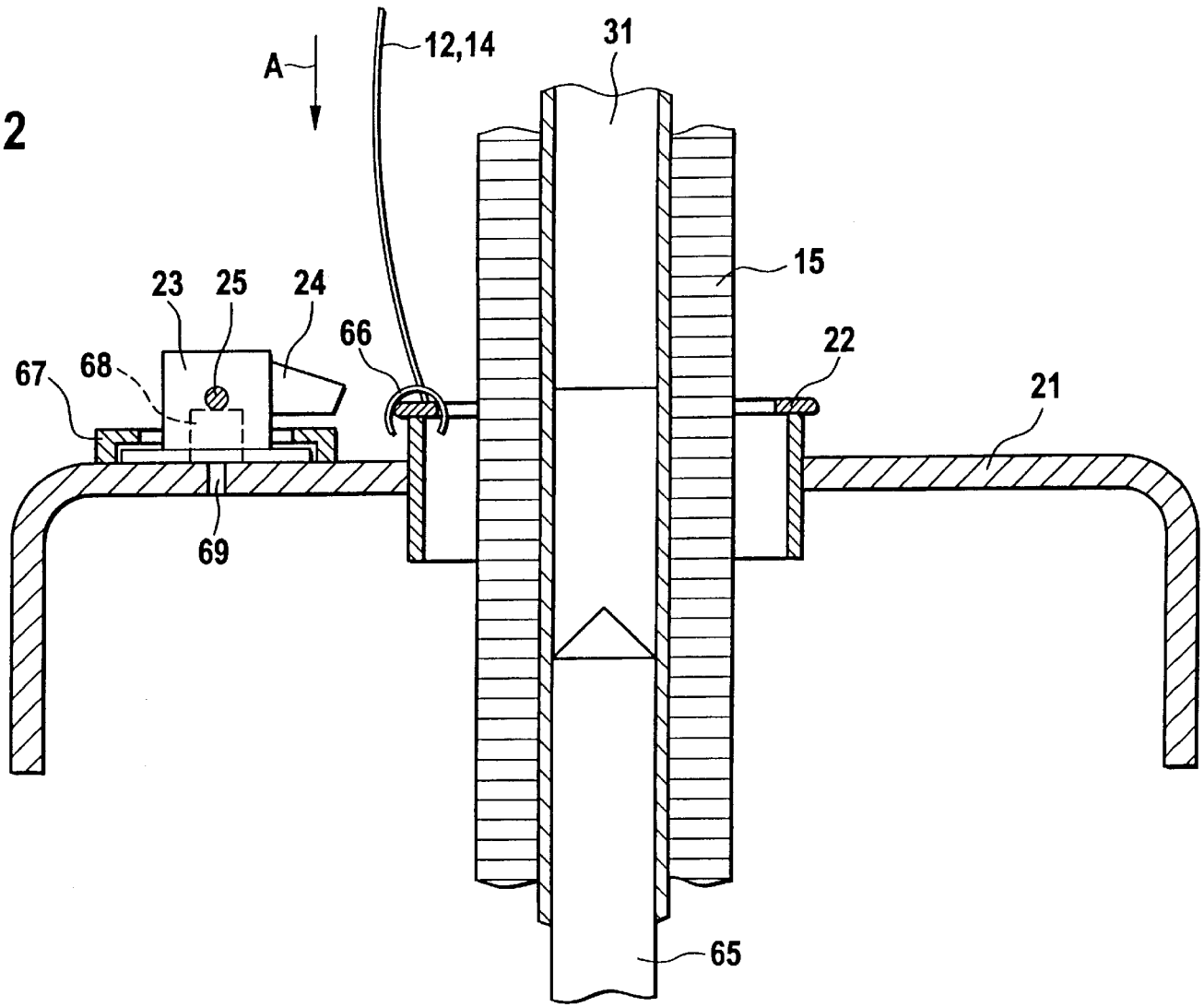
FIG. 2 is a greatly enlarged partial view of FIG. 1 in the area of the first carriage having devices for detecting an end break.

Shown in the enlarged partial view in FIG. 2 are the ring rail 21 with a spinning ring 22, a bobbin 15, the first carriage 23 having a flexible traction means 25 and a sensor 24 for detecting a broken thread 12, as well as a winding tube 31 supporting the bobbin 15, which winding tube 31 is placed on a rotating spindle shaft 65 of the spindle upper part 16 with the aid of a coupling means (not shown).

A ring traveller 66 rotates in a known way during operation on the spinning ring 22, which ring traveller 66 is scanned by the sensor 24 for monitoring end breaks. As long as the ring traveller 66 rotates, the sensor 24 does not indicate an end break. As the ring traveller 66 is movable up and down with the traverse motion ring rail 21, it is convenient to guide the first carriage 23 comprising the sensor 24 on the ring rail 21 in a sliding motion. A travel rail 67 is thus additionally still arranged at the ring rail 21 which travel rail 67 fixes the first carriage 23.

In order that the sensor 24 does not indicate an end break between two spinning stations 4, where there is neither a thread 12 nor a ring traveller 66, a further sensor 68 for identifying a spinning station 4 is arranged at the sensor 24. Only then when the sensor 68 registers a spinning station 4 is the sensor 24 for detecting an end break activated. A spinning station 4 can be easily recognized in that the ring rail 21 comprises a bore hole 69 at each spinning station 4. When the sensor 68 recognizes a bore hole 69, it can open a measure window for the sensor 24.

Figure 3:
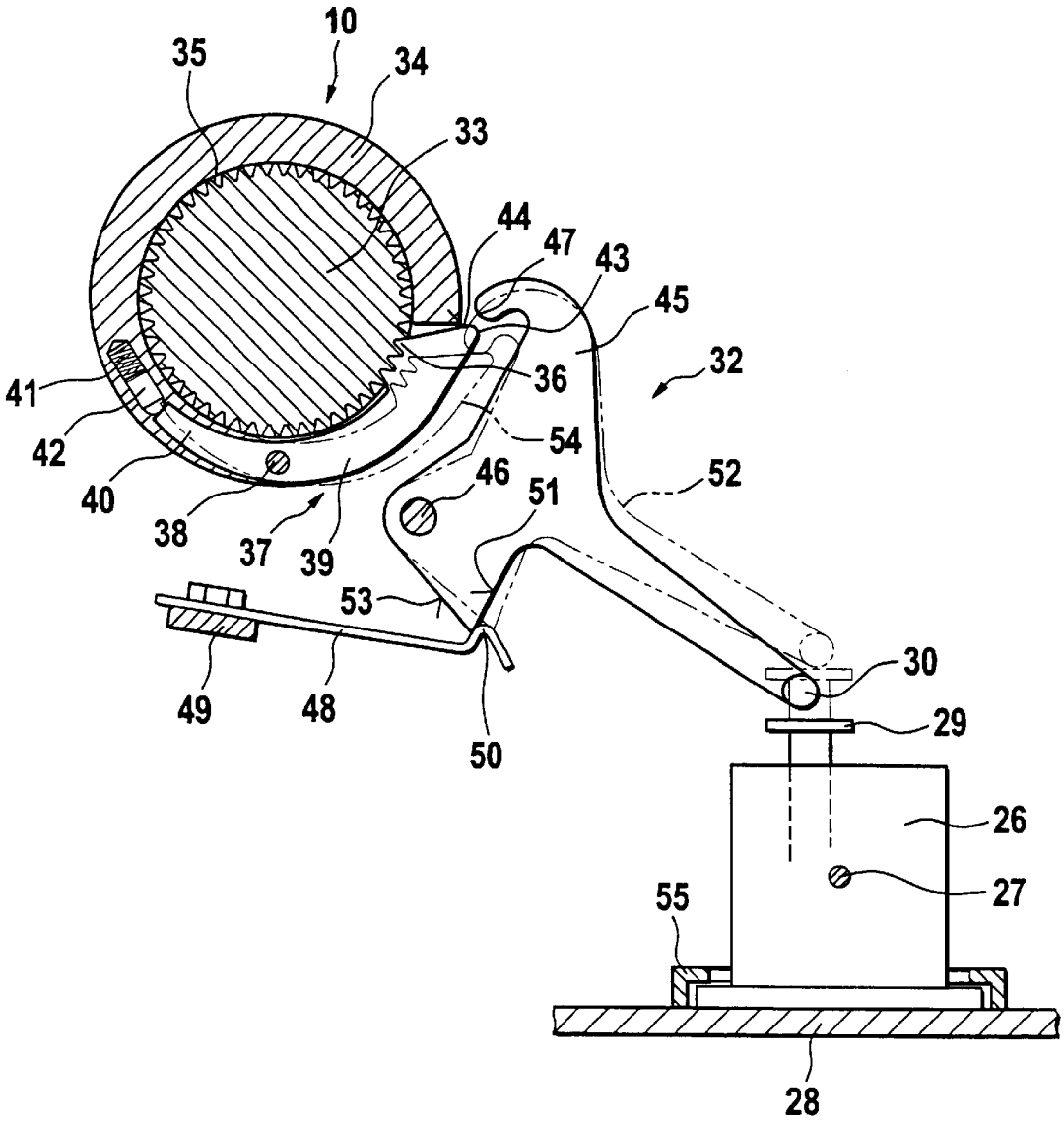
FIG. 3 is a greatly enlarged partial view from FIG. 1 in the area of a stopping device for fiber material feed arranged to a drafting unit.

In the enlarged representation in FIG. 3, the entry bottom roller 10, the activating lever 30 already mentioned, the carriage 26 comprising flexible traction means 27 and its actuator 29 as well as a part of the suction channel 28, on which the second carriage 26 is secured by means of an additional sliding rail 55, are shown.

As can be seen in FIG. 3, a stopping device 32 for stopping the feed of fiber material 11 is arranged to the entry bottom roller 10. The design of such a stopping device 32 is optional, so that the following description is just an advantageous embodiment.

In the case of the stopping device 32 shown, a drive shaft 33 of the entry bottom roller 10, extending continuously in machine longitudinal direction, is provided with a connectable tube 34, which can be individually stopped via coupling means. While the drive shaft 33 is driven in the known way from the headstock of the spinning machine 1 and rotates continuously during operation, the tube 34 of each respective drafting unit 5 has a width which is adapted to the fiber material 11 to be drafted. In the area of a front side of the tube 34, a locking device 35 is applied in the drive shaft 33, which locking device 35 has only a relatively small width and which is covered by the tube 34. The locking device 35 takes the form of an all-round toothed device.

The locking device 35 serves to connect the tube 34 to the drive shaft 33 during operation so that they are interlocked, and in the case of a malfunction, to individually shut down the tube 34 despite the drive shaft 33 continuing to run. A gear 36 of the tube 34 is therefore arranged to the locking device 35, which gear 36 can engage in the locking device 35 and which is located on a swiveling lever 37, whose swivel axle 38 is arranged on the tube 34. The swivel axle 38 is hereby in the form of a linch pin, which extends parallel to the drive shaft 33 and which is inserted into the tube 34 with press fit. The swivel lever 37 is supported on this linch pin with clearance.

The swivel lever 37, whose width corresponds to the width of the locking device 35, takes the form of a two-armed lever. One lever arm 39 bears the gear 36, the second lever arm 40 is loaded with a pressure spring 41, which loads the end of the lever arm 40 via a pin 42 and thus tries to turn the swivel lever 37 in such a way that the gear 36 engages in the locking device 35. The pressure spring 41 thus strives to connect the tube 34 to the drive shaft 33.

As can be seen, the pressure spring 41 and the pin 42 are arranged in the inside of the tube 34, so that from the outside only the swivel lever 37 is visible. It covers the locking device 35 from the outside.

With an extension 43, the swivel lever 37 projects, on the side of the lever arm 39 which bears the gear 36, out of the tube 34 towards the outside. Thus an engaging surface 44 for a releasing lever 45 is created, which is integral with the activating lever 30 already mentioned.

The releasing lever 45 is supported in the area of the entry bottom cylinder 10 on a stationary swivel axle 46. This swivel axle 46 has a cam 47 which is located during normal spinning operation at a short distance above the above mentioned engaging surface 44 of the swivel axle 37. The cam 47 is held in this lightly released position by means of a leaf spring 48, which is clamped onto a fixing element 49 and which is disposed with a bend 50 against a surface 51 of the releasing lever 45 arranged thereto. The bend 50 thus serves as a locking device.

In order to activate the stopping device 32, the releasing lever 45 can be swivelled by depressing the resilient bend 50 into a position 52 shown by a dot-dash line, in which position 52 the bend 50 of the leaf spring 48 is then disposed on another surface 53 of the releasing lever 45. Thus the position 52, shown by a dot-dash line, of the releasing lever 45 is also secured, namely then when the cam 47 of the activated stopping device 32 presses against the engaging surface 44 of the swivel axle 37 and by means thereof presses the swivel axle 37 in a position 54 shown also by a dot-dash line, in which the gear 36 of the swivel lever 37 is disengaged from the locking device 35 of the drive s haft 33. The drive between the drive shaft 33 and the tube 34 is then interrupted, so that no further fiber material 11 is fed to the drafting unit 5.

Figure 4:
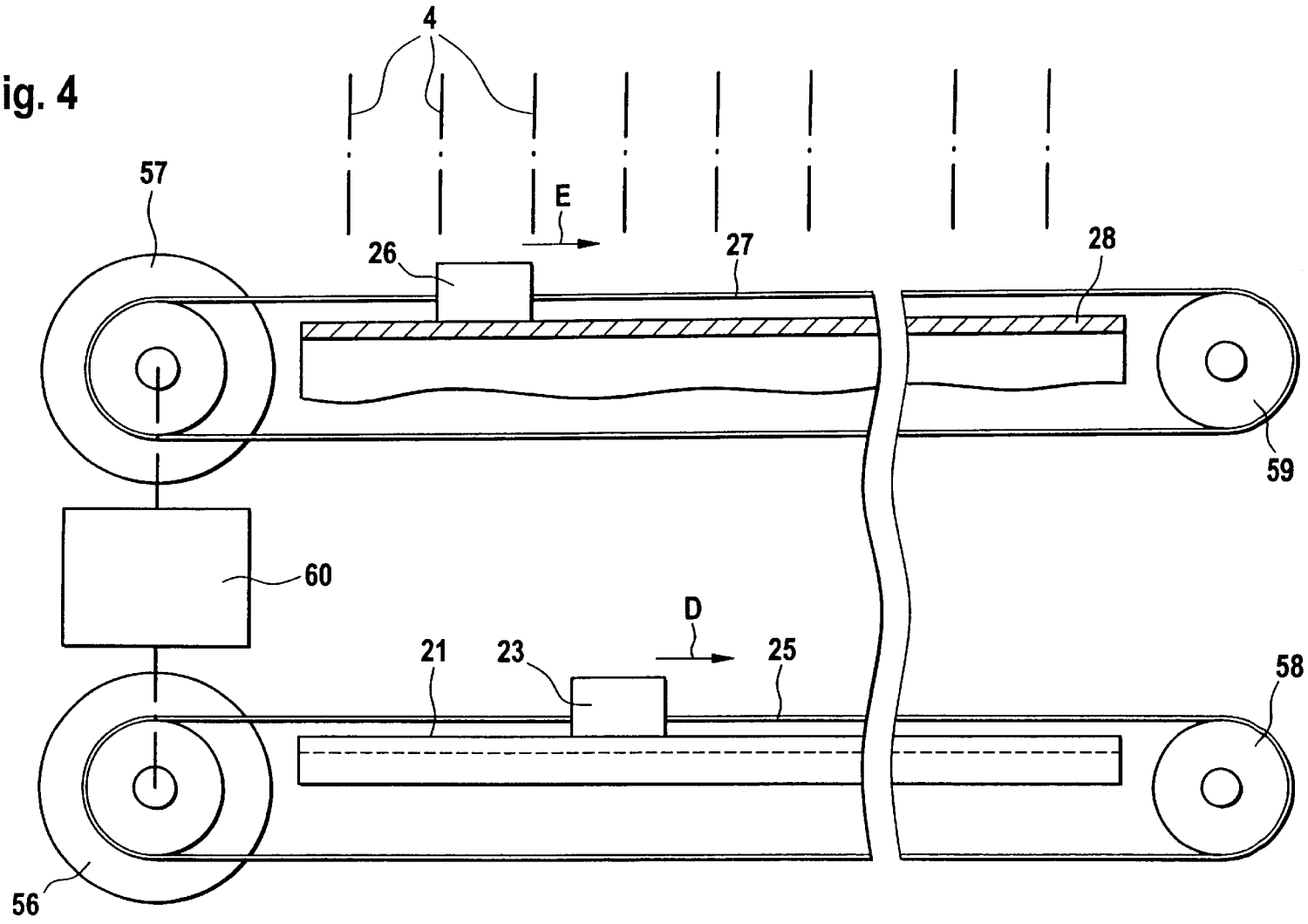
FIGS. 4 and 5 are a greatly reduced and schematic longitudinal view of two variations for driving and coupling the first and second carriages.

When the first carriage 23 travels over the defect spinning station 4, that is when the sensor 24 of the first carriage 23 has indicated an end break, the actuator 29 of the second carriage 26 can activate the activating lever 30 and thus the swivel axle 37. The stopping device 32 is released, which prevents further feeding of fiber material 11.

electric coupling is schematically shown in FIG. 4 between the first carriage 23 and the second carriage 26. The two flexible, electrocondutive traction means 25 and 27 can be seen as well as the two travel rails, namely the ring rail 21 as well as the upper edge of the suction channel 28. The individual spinning stations 4 are denoted only by dot-dash lines.

As shown in FIG. 4, each carriage 23 and 26 has its own drive motor 56 or 57. Each of these drive motors 56,57 thus activates the respective flexible traction means 25 or 27 arranged thereto. At the other end of the machine, the traction means 25,27 are guided by respective guiding discs 58 and 59.

Because both traction means 25 and 27 are electroconductive, end breaks detected by the sensor 24 can be transmitted via electric signals to a computer 60 located in the headstock of the spinning machine 1. This computer 60 transmits the signals of the first carriage 23 to the second carriage 26 and thus to the actuator 29. It is hereby practical when—as shown by one travel direction D or E of the traversing carriages 23 and 26—the second carriage 26 follows behind the first carriage 23 at a certain, though not too great a distance. Thus end breaks can be eliminated directly after their detection.

Figure 5:
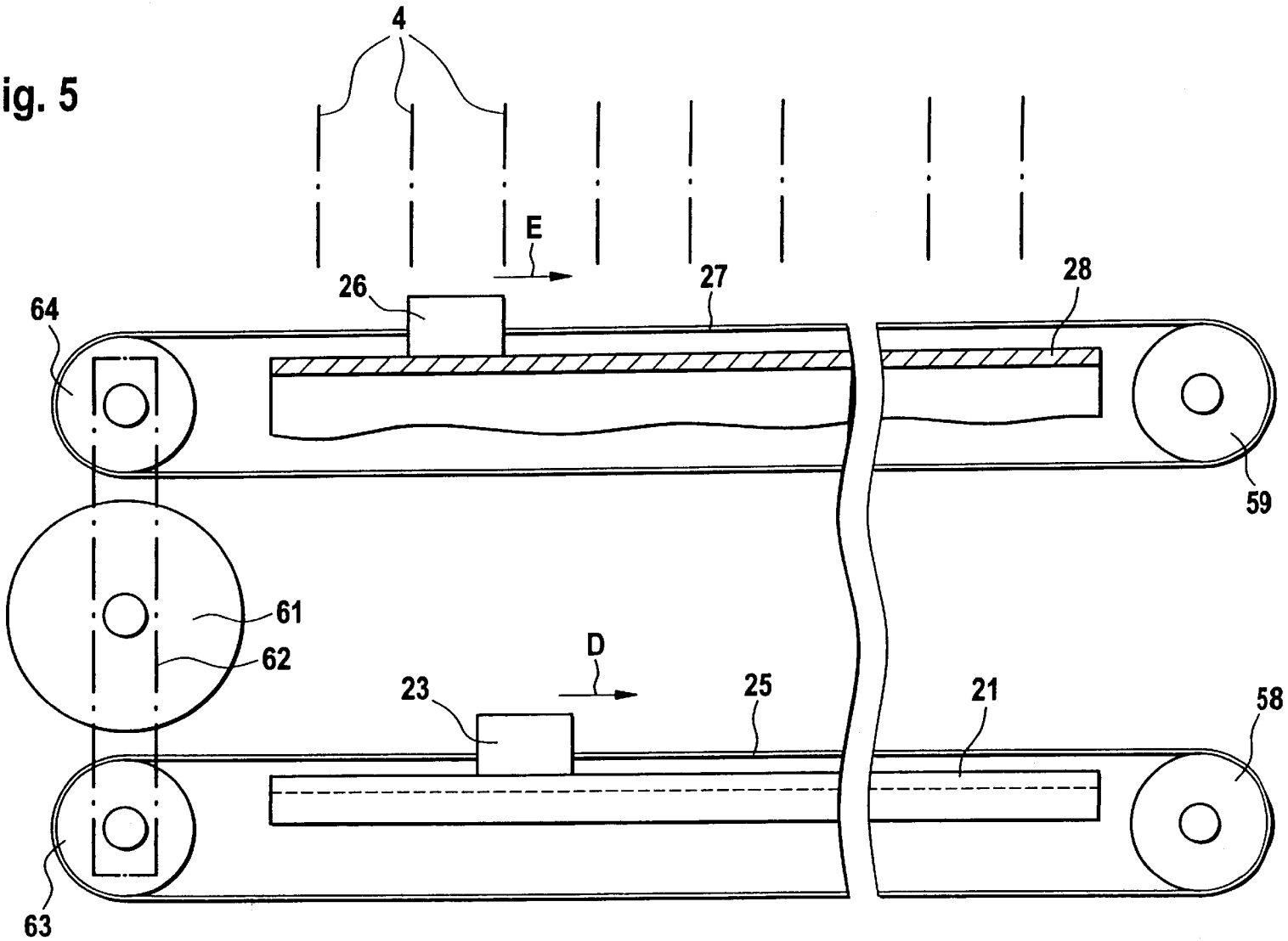

In the schematic representation shown in FIG. 5, a mechanical coupling takes place in the headstock of the spinning machine 1, so that a complicated electronic system and electronic spinning station counters can be omitted.

According to FIG. 5, a joint drive motor 61 is arranged to the traction means 25 and 27 of both carriages 23 and 26. The second carriage 26 can hereby follow the first carriage 23 at a constant distance, for example at three quarters the distance between two spinning stations 4. In the present case, only guiding discs 63 and 64 are arranged on the drive side to the traction means 25 and 27.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed:

1. A spinning machine comprising:

a plurality of spinning stations, a drafting unit in each spinning station, said drafting units each including a stopping device for stopping feeding of fiber material, a first carriage movable along the spinning stations, said first carriage having a sensor for detecting a thread breakage at a spinning station, and a second carriage movable along the spinning stations, said second carriage having an actuator for activating the stopping device of a spinning station.

2. A spinning machine according to claim 1, wherein both carriages can be pulled backwards and forwards by flexible traction members along a traveling rail.

3. A spinning machine according to claim 2, wherein at least one drive motor which activates the traction members is arranged to each carriage.

4. A spinning machine according to claim 3, wherein the traction members are electroconductive and wherein end break signals are transmitted via the traction members from the sensor of the first carriage to the actuator of the second carriage.

5. A spinning machine according to claim 1, wherein both carriages are pulled in the same direction along the spinning machine and wherein the second carriage follows the first carriage at a certain distance behind.

6. A spinning machine according to claim 2, wherein both carriages are pulled in the same direction along the spinning machine and wherein the second carriage follows the first carriage at a certain distance behind.

7. A spinning machine according to claim 3, wherein both carriages are pulled in the same direction along the spinning machine and wherein the second carriage follows the first carriage at a certain distance behind.

8. A spinning machine according to claim 4, wherein both carriages are pulled in the same direction along the spinning machine and wherein the second carriage follows the first carriage at a certain distance behind.

9. A spinning machine according to claim 2, wherein a joint drive motor having an intermediate gearing is arranged at the traction means of both carriages.

10. A spinning machine according to claim 9, wherein the second carriage follows the first carriage at a constant distance.

11. A spinning machine according to claim 1, wherein the first carriage is guided on a ring rail arranged at the spinning machine.

12. A spinning machine according to claim 2, wherein the first carriage is guided on a ring rail arranged at the spinning machine.

13. A spinning machine according to claim 3, wherein the first carriage is guided on a ring rail arranged at the spinning machine.

14. A spinning machine according to claim 4, wherein the first carriage is guided on a ring rail arranged at the spinning machine.

15. A spinning machine according to claim 5, wherein the first carriage is guided on a ring rail arranged at the spinning machine.

16. A spinning machine according to claim 9, wherein the first carriage is guided on a ring rail arranged at the spinning machine.

17. A spinning machine according to claim 10, wherein the first carriage is guided on a ring rail arranged at the spinning machine.

18. A spinning machine according to claim 1, wherein a sensor for identifying a spinning station is arranged at the sensor for detecting a broken thread.

19. A spinning machine according to claim 2, wherein a sensor for identifying a spinning station is arranged at the sensor for detecting a broken thread.

20. A spinning machine according to claim 3, wherein a sensor for identifying a spinning station is arranged at the sensor for detecting a broken thread.

21. A spinning machine according to claim 4, wherein a sensor for identifying a spinning station is arranged at the sensor for detecting a broken thread.

22. A spinning machine according to claim 5, wherein a sensor for identifying a spinning station is arranged at the sensor for detecting a broken thread.

23. A spinning machine according to claim 9, wherein a sensor for identifying a spinning station is arranged at the sensor for detecting a broken thread.

24. A spinning machine according to claim 10, wherein a sensor for identifying a spinning station is arranged at the sensor for detecting a broken thread.

25. A spinning machine according to claim 1, wherein a sensor for identifying a spinning station is arranged at the sensor for detecting a broken thread.

26. A spinning machine according to claim 1, wherein the spinning machine is a ring spinning machine.

27. An assembly for responding to thread break at individual spinning stations of a multistation spinning machine having fiber supply stopping devices at each spinning station comprising:

a first carriage movable along the spinning stations, said first carriage having a sensor for detecting a thread breakage at a spinning station, and a second carriage movable along the spinning stations, said second carriage having an actuator for activating the stopping device of a spinning station.

28. An assembly according to claim 27, wherein the first carriage is on a flexible traction member.

29. An assembly according to claim 27, wherein the first carriage is carried on a flexible traction member which in use can be pulled in forward and rearward directions along a traveling rail.

30. An assembly according to claim 28, wherein the second carriage is carried on another flexible traction member.

31. An assembly according to claim 29, wherein the second carriage is carried on another flexible traction member which in use can be pulled in forward and rearward directions along a traveling rail.

32. A method of operating a ring spinning machine having a plurality of spinning stations which each have a fiber supply stopping device, said method comprising:

detecting thread breakages at individual spinning stations using a sensor on a first carriage moveable along the spinning stations, and actuating respective fiber supply stopping devices using an actuator on a second carriage moveable along the spinning stations.

33. A method according to claim 32, wherein both carriages can be pulled backwards and forwards by flexible traction members along a traveling rail.

* * * * *